US009217597B2

(12) United States Patent
Mueller et al.

(10) Patent No.: US 9,217,597 B2
(45) Date of Patent: Dec. 22, 2015

(54) LOW PRESSURE CONTROL FOR SIGNALING A TIME DELAY FOR ICE MAKING CYCLE START UP

(75) Inventors: Lee Gerard Mueller, Kewaunee, WI (US); Daryl G. Erbs, Sheboygan, WI (US)

(73) Assignee: Manitowoc Foodservice Companies, LLC, Manitowoc, WI (US)

( * ) Notice: Subject to any disclaimer, the term of this patent is extended or adjusted under 35 U.S.C. 154(b) by 943 days.

(21) Appl. No.: 13/195,574

(22) Filed: Aug. 1, 2011

(65) Prior Publication Data

US 2012/0031115 A1 Feb. 9, 2012

Related U.S. Application Data

(60) Provisional application No. 61/370,420, filed on Aug. 3, 2010.

(51) Int. Cl.
*F25C 1/04* (2006.01)
*F25C 5/10* (2006.01)
(Continued)

(52) U.S. Cl.
CPC ... *F25C 5/10* (2013.01); *F25C 1/04* (2013.01); *F25C 2600/02* (2013.01); *F25C 2600/04* (2013.01); *F25C 2700/02* (2013.01)

(58) Field of Classification Search
CPC ..... F25C 1/12; F25C 1/00; F25C 2600/02; F25C 2600/04; F25C 2700/02; F25C 1/04; F25C 5/10; F25B 13/00; F25B 2600/23; C02F 1/22
USPC ..... 62/73, 138, 132, 158, 157, 161, 163, 3
See application file for complete search history.

(56) References Cited

U.S. PATENT DOCUMENTS 2,359,780 A * 10/1944 Muffly ..... 62/138
2,942,432 A * 6/1960 Muffly ..... 62/155
(Continued)

FOREIGN PATENT DOCUMENTS

CN 1257988 A 6/2000
CN 2532434 Y 1/2003
(Continued)

OTHER PUBLICATIONS

Japanese Office Action dated Feb. 20, 2014 for Japanese application No. 2013-523246.
(Continued)

*Primary Examiner* — Mohammad M Ali
*Assistant Examiner* — Meraj A Shaikh
(74) *Attorney, Agent, or Firm* — Ohlandt, Greeley, Ruggiero & Perle, LLP

(57) ABSTRACT

A method of making ice in an ice making machine comprising: (a) compressing vaporized refrigerant, cooling the compressed refrigerant to condense it into a liquid, feeding the condensed refrigerant through an expansion device and vaporizing the refrigerant in an evaporator to create freezing temperatures in an ice-forming mold to freeze water into ice in the shape of mold cavities during an ice making mode; (b) heating the ice making mold to release the ice therefrom in a harvest mode by separating vaporous and liquid refrigerant within a receiver interconnected between the condenser and the expansion device and feeding vapor from the receiver to the evaporator, wherein the ice-forming mold, evaporator and receiver are disposed in an ice machine unit, and the compressor and condenser are disposed in a condensing unit; (c) determining if the ice making machine is on and if an ice bin switch is closed: if the ice machine is on and the bin switch is closed, then check a low pressure switch: if the low pressure switch is not closed, then return to step (i) above; or if the low pressure switch is closed, then set a time delay for a predetermined time delay; and (d) determining if the predetermined time delay has elapsed: if the predetermined time delay has not elapsed, then return to step (d); or if the predetermined time delay has elapsed, then initiate another the ice making mode.

7 Claims, 4 Drawing Sheets

(51) Int. Cl.

| | |
|---|---|
| ***F25B 13/00*** | (2006.01) |
| ***F25C 1/12*** | (2006.01) |
| ***F25C 1/00*** | (2006.01) |

(56) References Cited

U.S. PATENT DOCUMENTS

| | | | | |
|---|---|---|---|---|
| 3,653,223 | A * | 4/1972 | Jones et al. | 62/160 |
| 4,480,441 | A * | 11/1984 | Schulze-Berge et al. | 62/138 |
| 4,831,834 | A | 5/1989 | Yoshida | |
| 4,899,552 | A | 2/1990 | Minari | |
| 5,123,948 | A | 6/1992 | Ruff | |
| 6,196,007 | B1 * | 3/2001 | Schlosser et al. | 62/73 |
| 6,681,580 | B2 | 1/2004 | Shedivy et al. | |
| 6,988,373 | B2 | 1/2006 | Wakatsuki | |
| 8,484,987 | B2 * | 7/2013 | Ducharme et al. | 62/138 |
| 8,616,013 | B2 * | 12/2013 | Kim et al. | 62/137 |
| 2006/0086107 | A1 * | 4/2006 | Voglewede et al. | 62/135 |
| 2009/0288429 | A1 * | 11/2009 | Elsom et al. | 62/68 |
| 2012/0000226 | A1 * | 1/2012 | Yamaguchi et al. | 62/157 |
| 2012/0031114 | A1 * | 2/2012 | Mueller et al. | 62/66 |
| 2012/0192575 | A1 * | 8/2012 | Tirumala et al. | 62/66 |
| 2012/0222434 | A1 * | 9/2012 | Gist et al. | 62/66 |

FOREIGN PATENT DOCUMENTS

| | | | |
|---|---|---|---|
| JP | 11316056 | A * | 11/1999 |
| JP | 1999316056 | | 11/1999 |
| JP | 2000213841 | A | 8/2000 |
| JP | 2002228297 | | 8/2002 |
| JP | 2005180825 | | 7/2005 |
| JP | 2009121768 | | 6/2009 |
| JP | 2009216326 | | 9/2009 |

OTHER PUBLICATIONS

International Search Report and Written Opinion dated Jan. 10, 2012 for corresponding International Patent Application No. PCT/US2011/046121.

International Preliminary Report on Patentability dated Aug. 28, 2012 corresponding International Application No. PCT/US11/46121.

English translation of First Office Action dated Jul. 25, 2013 for corresponding Chinese patent application No. 201110061638.2, pp. 11.

Chinese Office Action dated Apr. 1, 2014 for Chinese application No. 201110061638.2.

Mexican Office Action dated May 14, 2015 (with English translation) for Mexican application No. MX/a/2013/001368.

* cited by examiner

LOW PRESSURE CONTROL FOR SIGNALING A TIME DELAY FOR ICE MAKING CYCLE START UP

CROSS-REFERENCED APPLICATIONS

This application claims priority to U.S. Provisional Application Ser. No. 61/370,420, filed on Aug. 3, 2010, which is incorporated herein by reference in its entirety.

BACKGROUND

1. Field

The present disclosure relates to automatic ice making machines, and more particularly to an automatic ice making machine where the ice making evaporator is defrosted in a harvest mode by cool refrigerant vapor and where a low pressure control is used to signal a time delay before the ice machine starts up a new ice production mode or freeze cycle.

2. Discussion of the Background Art

Automatic ice making machines rely on refrigeration principles well-known in the art. During an ice making mode, the machines transfer refrigerant from the condensing unit to the evaporator to chill the evaporator and an ice-forming evaporator plate below freezing. Water is then run over or sprayed onto the ice-forming evaporator plate to form ice. Once the ice has fully formed, a sensor switches the machine from an ice production mode to an ice harvesting mode. During harvesting, the evaporator must be warmed slightly so that the frozen ice will slightly thaw and release from the evaporator plate into an ice collection bin. To accomplish this, most prior art ice making machines use a hot gas valve that directs hot refrigerant gas routed from the compressor straight to the evaporator, bypassing the condenser.

In a typical automatic ice making machine, the compressor and condenser unit generates a large amount of heat and noise. As a result, ice machines have typically been located in a back room of an establishment, where the heat and noise do not cause as much of a nuisance. This has required, however, the ice to be carried from the back room to where it is needed. Another problem with having the ice machine out where the ice is needed is that in many food establishments, space out by the food service area is at a premium, and the bulk size of a normal ice machine is poor use of this space.

Several ice making machines have been designed in an attempt to overcome these problems. In typical "remote" ice making machines, the condenser is located at a remote location from the evaporator and the compressor. This allows the condenser to be located outside or in an area where the large amount of heat it dissipates and the noise from the condenser fan would not be a problem. However, the compressor remains close to the evaporator unit so that it can provide the hot gas used to harvest the ice. While a typical remote ice making machine solves the problem of removing heat dissipated by the condenser, it does not solve the problem of the noise and bulk created by the compressor.

Other ice machine designs place both the compressor and the condenser at a remote location. These machines have the advantage of removing both the heat and noise of the compressor and condenser to a location removed from the ice making evaporator unit. For example, U.S. Pat. No. 4,276,751 to Saltzman et al. describes a compressor unit connected to one or more remote evaporator units with the use of three refrigerant lines. The first line delivers refrigerant from the compressor unit to the evaporator units, the second delivers hot gas from the compressor straight to the evaporator during the harvest mode, and the third is a common return line to carry the refrigerant back from the evaporator to the compressor. The device disclosed in the Saltzman patent has a single pressure sensor that monitors the input pressure of the refrigerant entering the evaporator units. When the pressure drops below a certain point, which is supposed to indicate that the ice has fully formed, the machine switches from an ice making mode to a harvest mode. Hot gas is then piped from the compressor to the evaporator units.

U.S. Pat. No. 5,218,830 to Martineau also describes a remote ice making system. The Martineau device has a compressor unit connected to one or more remote evaporator units through two refrigerant lines: a supply line and a return line. During an ice making mode, refrigerant passes from the compressor to the condenser, then through the supply line to the evaporator. The refrigerant vaporizes in the evaporator and returns to the compressor through the return line. During the harvest mode, a series of valves redirect hot, high pressure gas from the compressor through the return line straight to the evaporator to warm it. The cold temperature of the evaporator converts the hot gas into a liquid. The liquid refrigerant exits the evaporator and passes through a solenoid valve and an expansion device to the condenser. As the refrigerant passes through the expansion device and the condenser it vaporizes into a gas. The gaseous refrigerant then exits the condenser and returns to the compressor.

One of the main drawbacks of these prior systems is that the long length of the refrigerant lines needed for remote operation causes inefficiency during the harvest mode. This is because the hot gas used to warm the evaporator must travel the length of the refrigeration lines from the compressor to the evaporator. As it travels, the hot gas loses much of its heat to the lines' surrounding environment. This results in a longer and more inefficient harvest cycle. In addition, at long distances and low ambient temperatures, the loss may become so great that the hot gas defrost fails to function properly at all.

Some refrigeration systems that utilize multiple evaporators in parallel have been designed to use hot gas to defrost one of the evaporators while the others are in a cooling mode. For example, in a grocery store with multiple cold and frozen food storage and display cabinets, one or more compressors may feed a condenser and liquid refrigerant manifold which supplies separate expansion devices and evaporators to cool each cabinet. A hot gas defrost system, with a timer to direct the hot gas to one evaporator at a time, is disclosed in U.S. Pat. No. 5,323,621. Hot gas defrosting in such systems is effective even though the compressor is located remotely from the evaporators due to the large latent heat load produced by the refrigerated fixtures in excess of the heat required to defrost selected evaporator coils during the continued refrigeration of the remaining fixtures. While there are some inefficiencies and other problems associated with such systems, a number of patents disclose improvements thereto, such as U.S. Pat. Nos. 4,522,037 and 4,621,505. These patents describe refrigeration systems in which saturated refrigerant gas is used to defrost one of several evaporators in the system. The refrigeration systems include a surge receiver and a surge control valve which allows hot gas from the compressor to bypass the condenser and enter the receiver. However, these systems are designed for use with multiple evaporators in parallel, and would not function properly if only a single evaporator, or if multiple evaporators in series, were used. Perhaps more importantly, these systems are designed for installations in which the cost of running refrigerant lines between compressors in an equipment room, an outdoor condenser, and multiple evaporators in the main part of a store is not a significant factor in the design. These refrigeration systems would not be cost effective, and perhaps not even practicable, if they were applied to ice making machines.

A good example of such a situation is U.S. Pat. No. 5,381,665 to Tanaka, which describes a refrigeration system for a food showcase that has two evaporators in parallel. A receiver supplies vaporous refrigerant to the evaporators through the same feed line as is used to supply liquid refrigerant to the evaporators. The system has a condenser, compressor and evaporators all located separately from one another. Such a system would not be economical if applied to ice machines where different sets of refrigerant lines had to be installed between each of the locations of the various parts. Moreover, if the compressor and its associated components were moved outdoors to be in close proximity to a remote condenser, the system would not be able to harvest ice at low ambient temperature because the receiver would be too cold to flash off refrigerant when desired to defrost the evaporators.

U.S. Pat. No. 5,787,723 discloses a remote ice making machine which overcomes the drawbacks mentioned above. One or more remote evaporating units are supplied with refrigerant from a remote condenser and compressor. Moreover, if a plurality of evaporating units are used, they can be operated independently in a harvest or ice making mode. The heat to defrost the evaporators in a harvest mode is preferably supplied from a separate electrical resistance heater. While electrical heating elements have proved satisfactory for harvesting ice from the evaporator, they add to the expense of the product. Thus, a method of harvesting the ice in the remote ice machine of U.S. Pat. No. 5,787,723 without electrical heating elements would be a great advantage. An ice making machine that includes a defrost system that utilizes refrigerant gas and can be used where the system has only one evaporator, or an economically installed system with multiple evaporators that also operates at low ambient conditions, would also be an advantage.

An ice making machine has been commercially marketed in which the compressor and condenser are remote from the evaporator but does not require electrical heaters to heat the ice-forming mold, nor does it require hot gas to travel to the evaporator from the compressor. In addition, the refrigeration system will function in low ambient conditions, and is not expensive to install.

One example is an ice making machine comprising: a) a water system including a pump, an ice-forming mold and interconnecting lines therefore; and b) a refrigeration system including a compressor, a condenser, an expansion device, an evaporator in thermal contact with the ice-forming mold, and a receiver, the receiver having an inlet connected to the condenser, a liquid outlet connected to the expansion device and a vapor outlet connected by a valved passageway to the evaporator.

The use of cool vapor (i.e., cool refrigerant vapor from a receiver) to defrost an evaporator has several advantages. It eliminates the need for an electrical heating unit, or the problems associated with piping hot gas over a long distance in a remote compressor configuration. Since the cool vapor is located inside the evaporator coil, there is excellent heat transfer to those parts of the system that need to be warmed. The system can be used to defrost the evaporator where there is only one evaporator in the refrigeration system, or multiple evaporators in series, as well as evaporators in parallel.

In U.S. Pat. No. 6,196,007 cool vapor defrost from the compressor is cycled on and off based on the low pressure control-pump down cycle, wherein U.S. Pat. No. 6,196,007 is incorporated reference herein in its entirety. The disadvantage of this system is that over time this creates excessive cycling of wear on the start and/or run capacitor(s), relays and contactors, due to short cycling which, in turn, causes heating up of the electrical components.

The present inventors have discovered that such component failures result from a lack of cool down time. That is, due to communication between the ice machine and condensing unit a time delay can be used to extend the life of starting components and compressor life. That is, by monitoring the low pressure control, a time delay before restarting the compressor in an ice making mode can save on the life of the compressor and starting components, e.g., run capacitor, start capacitor and potential relay. Moreover, since the ice machine is located remotely away from the condensing unit, the status of the condensing unit can be checked at the ice machine. For example by checking the voltage at the wire connection in the ice machine one can determine if there is voltage at the condensing unit. Use of a low pressure control-pump down cycle avoids migration of refrigerant into the compressor, thereby avoiding slugging, i.e., damage to reed valves and other components.

SUMMARY

A method of making ice in an ice making machine comprising: (a) compressing vaporized refrigerant, cooling the compressed refrigerant to condense it into a liquid, feeding the condensed refrigerant through an expansion device and vaporizing the refrigerant in an evaporator to create freezing temperatures in an ice-forming mold to freeze water into ice in the shape of mold cavities during an ice making mode; (b) heating the ice making mold to release the ice there from in a harvest mode by separating vaporous and liquid refrigerant within a receiver interconnected between the condenser and the expansion device and feeding vapor from the receiver to the evaporator, wherein the ice-forming mold, evaporator and receiver are disposed in an ice machine unit, and the compressor and condenser are disposed in a condensing unit; (c) determining if the ice making machine is on and if an ice bin switch is closed: if the ice machine is on and the bin switch is closed, then check a low pressure switch: if the low pressure switch is not closed, then return to step (i) above; or if the low pressure switch is closed, or the high pressure control is open, then set a time delay for a predetermined time delay; and (d) determining if the predetermined time delay has elapsed: if the predetermined time delay has not elapsed, then return to step (d); or if the predetermined time delay has elapsed, then initiate another the ice making mode.

In particular, the initiation of another ice making mode comprises: closing a cool vapor defrost relay and energizing a contactor coil on the condensing unit.

The method further comprising: determining if an ice bin is at or above a predetermined level: if the ice bin is below the predetermined level, then continue to check to determine when the ice bin is full; or if the ice bin is at or above the predetermined level, then shut the ice making machine off and pump down until a low pressure control switch opens. After opening the low pressure switch, the method further comprises the step of determining if the ice making machine is on and the bin switch is closed.

The method further comprising, during the harvest mode, the step of feeding vaporous refrigerant to the receiver from the compressor by bypassing the condenser through a head pressure control valve.

During the ice making mode liquid refrigerant passes from the condenser to the receiver through a liquid line and during the harvest mode vaporous refrigerant passes through the liquid line into the receiver.

Another feature is to monitor the high pressure control (HPC) on the condensing unit. When the high pressure control opens the control board will delay the condensing unit from restarting for a time limit of around 60 minutes. This allows the compressor to cool down and reduce excessive starting cycles also. The control will indicate on the display of the ice machine that it is in a time delay mode for the servicer to check out any problems on the condensing up on the roof.

DETAILED DESCRIPTION OF THE PREFERRED EMBODIMENT

Figure 1:
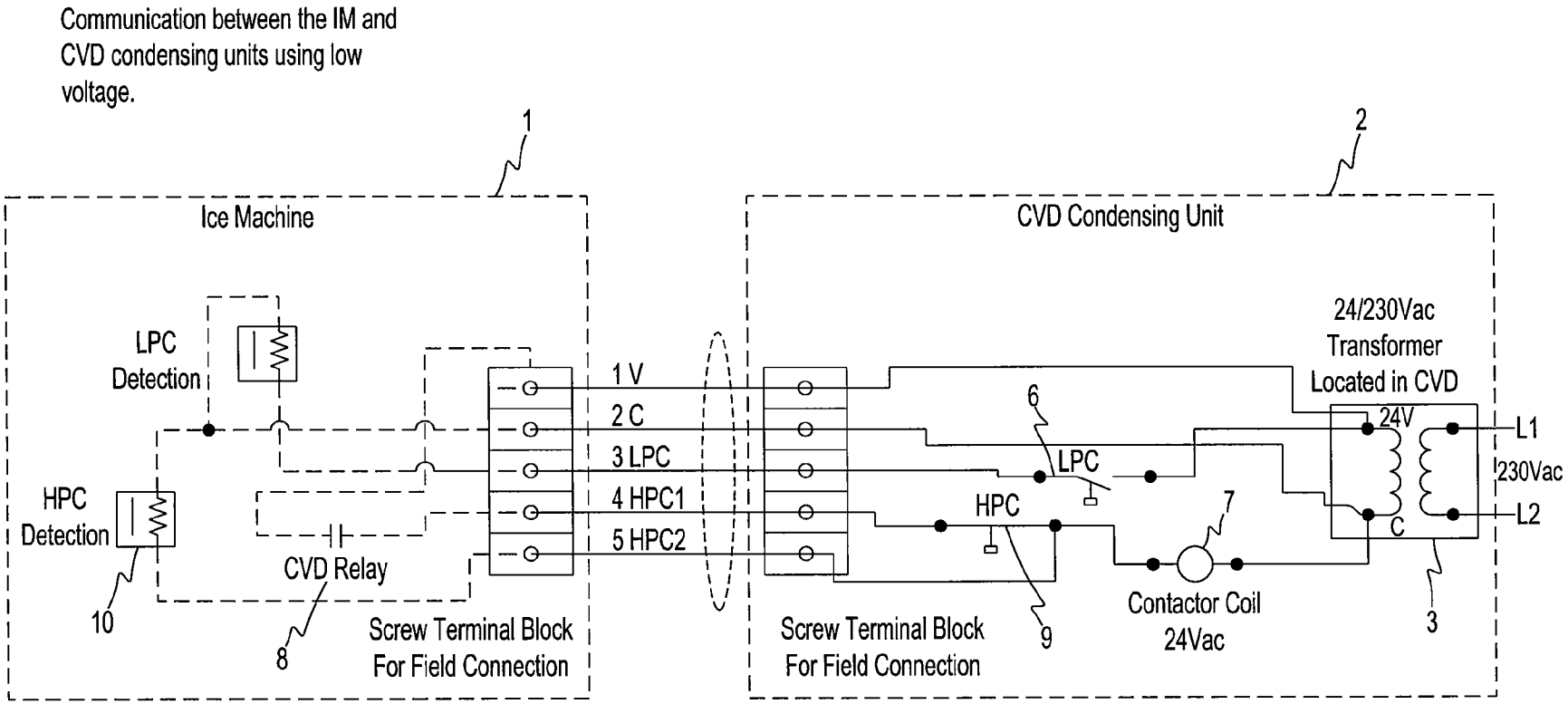
FIG. 1 is a wiring diagram of a communication system between an ice machine and a cool vapor defrost (CVD) condensing unit.
Figure 2:
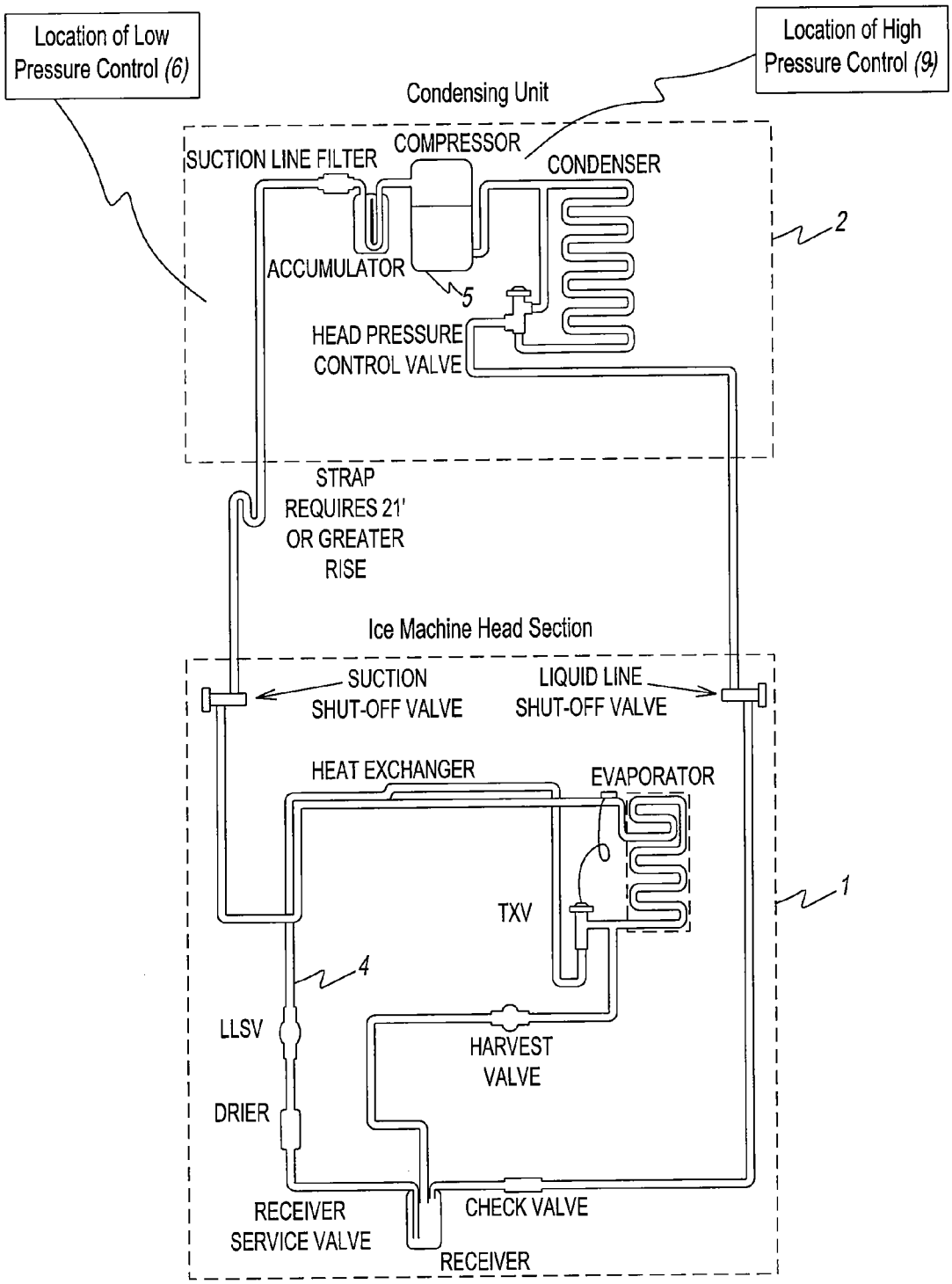
FIG. 2 is a schematic representation of an ice machine system according to the present disclosure.

The system and method according to present disclosure is best described by reference to the attached figures, wherein FIGS. 1 and 2 depict the communication between an ice machine 1 and a CVD condensing unit 2. In particular, a low voltage transformer supplies 24 VAC 3 is disposed between ice machine 1 and CVD condensing unit 2 for the control circuit. When ice machine 1 is turned off, or in a full bin condition the liquid line solenoid valve 4 will close in ice machine 1. Compressor 5 will continue to "pump down" or pull the pressure down until the LPC (Low Pressure Control) switch 6 opens in condensing unit 2. This will indicate to the control board in ice machine 1 to open the contactor for compressor 5. Ice machine 1 will then open up CVD relay circuit 8 on the control board, which then opens up the 24 volt contactor coil 7 on condensing unit 2. HPC (High Pressure Control) 9 is in series between contactor coil 7 and CVD relay circuit 8 for protection against high refrigeration pressures.

When LPC 6 opens there will be a 10 minute delay before ice machine 1 and CVD condensing unit 2 can re-start. This is to reduce short cycling for pump down cycles, or short cycling in full bin/dispenser applications. In a pump down cycle (Curtain switch open-full bin condition), after the 10 minute delay and LPC 6 is closed, CVD relay 8 on the control board will close to allow condensing unit 2 to pump down until LPC 6 opens again. At this point CVD relay 8 opens again and the process is repeated with a 10 minute delay until LPC opens 6 again.

Start up in ice making from a full bin condition (curtain switch closed), after the 10 minute delay liquid line solenoid valve 4 opens, causing the pressure to rise closing LPC 6, or it may be closed already, ice machine 1 will then go through a normal pre-chill cycle (water pump activates after 30 seconds). The 10 minute time delay can be defeated by cycling ice machine 1 on & off, or power interruption to the ice machine. The amount of time delay can vary based on the application and can range from 2 minutes to 12 with 10 minutes being the optimum for a CVD system.

HPC coil detection 10 on the control board is for monitoring the activation of HPC 9 on condensing unit 2, for a 60 minute time delay and diagnostics or alert the end uses of issues of the refrigeration system of not making ice. In the diagnostics LPC 6 and HPC 9 are counted individually. HPC 9 does not count the activation of CVD relay 8.

In FIG. 2 major components of the refrigerant system are indicated. The ice machine head 1 and the CVD 2 work in conjunction to manufacture the ice. Major components are described as follows; compressor 5, liquid line solenoid valve 4 (LLSV), low pressure control (6), and high pressure control 9.

Figure 3:
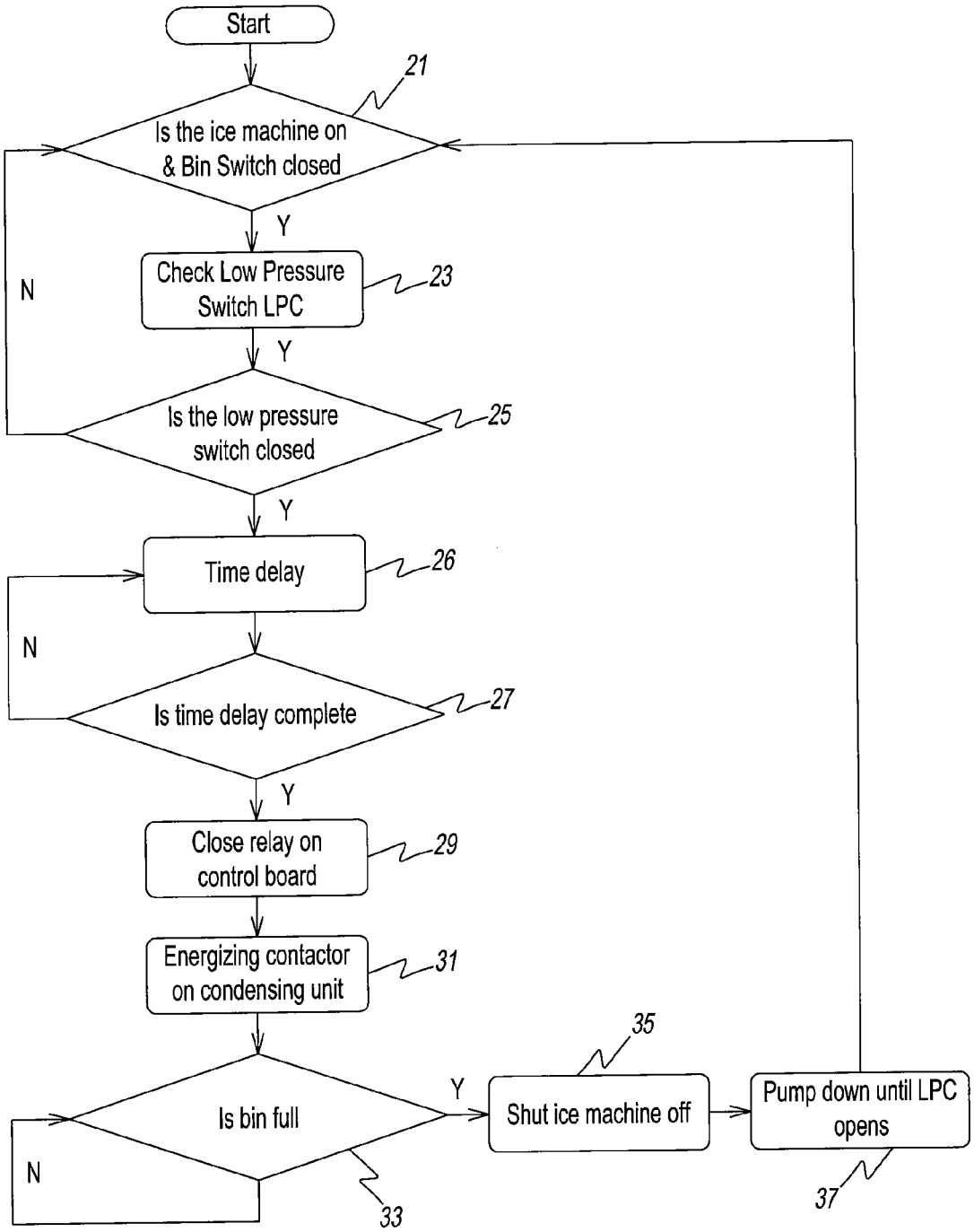
FIG. 3 is a logic diagram of the time delay system for monitoring the low pressure control according to the present disclosure.
Figure 4:
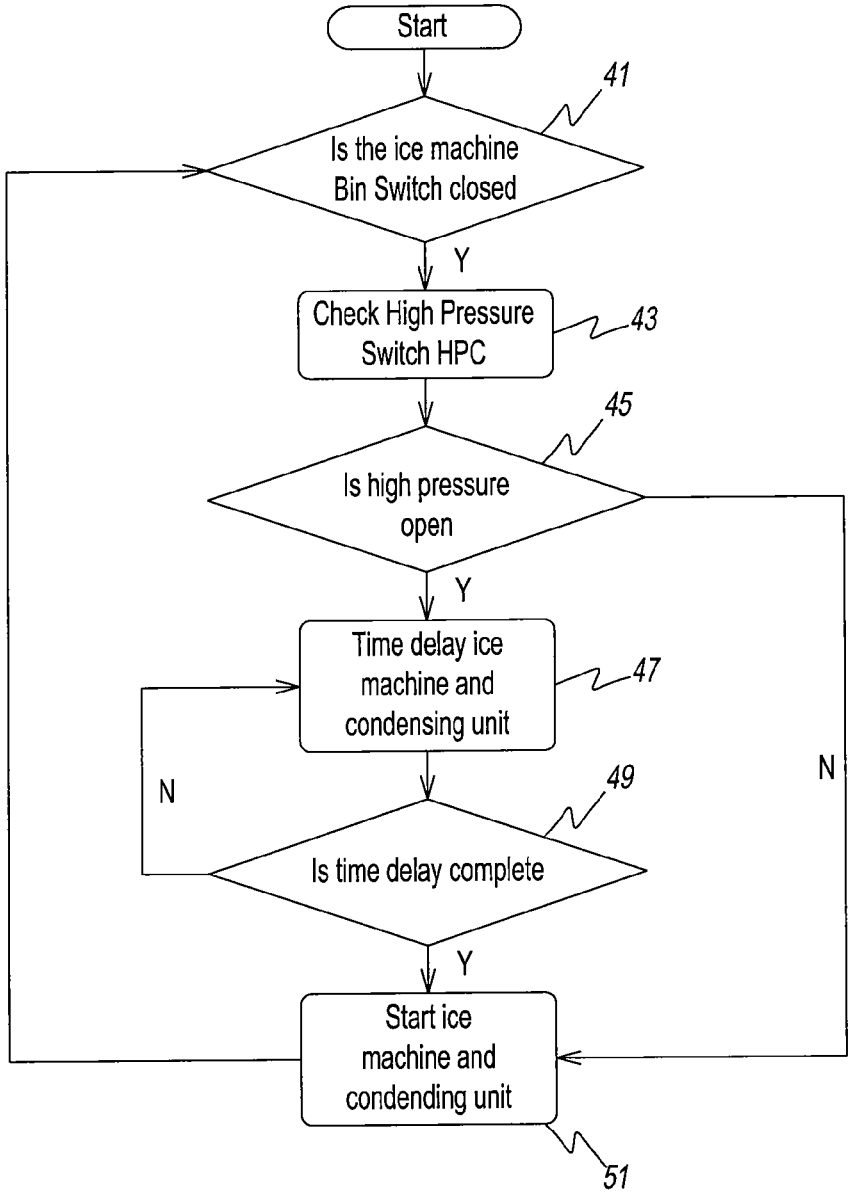
FIG. 4 is a logic diagram of the time delay system for monitoring the high pressure control according to the present disclosure.

FIG. 3 is a logic diagram which starts by checking to see if ice machine 1 is 'on' and if the bin switch is 'closed' 21. If the ice machine is off, then the electrical components are de-energized and the machine is not allowed to operate. Further if the machine is "on" and the bin switch is open (indicating a full bin), then the machine is not allowed to start until the bin switch is closed. If ice machine 1 is 'on' and the bin switch is 'closed', then check low pressure switch (LPC) 23. If the low pressure switch (LPC) 6 is not closed, then return to step 21 to see if ice machine is on and bin switch is closed. If the low pressure switch is closed 25, then set time delay 26 for a predetermined time delay (preferably, approximately 10 minutes). Thereafter, the system checks to see if time delay is complete 27. If time delay is not complete, then check again. If time delay is complete, then close CVD relay 8 on control board 29 and energize contactor coil 7 on condensing unit 2 (31).

Thereafter, the system checks to see if the ice bin is full 33. If bin is not full, then continue to check to determine when bin is full. If the bin is full, then shut ice machine 1 off 35 and pump down until LPC 6 opens 37. After opening LPC 6, check to see if the ice machine is on and bin switch is closed 21.

According to another embodiment, a method of making ice in an ice making machine comprising:

a) compressing vaporized refrigerant, cooling the compressed refrigerant to condense it into a liquid, feeding the condensed refrigerant through an expansion device and vaporizing the refrigerant in an evaporator to create freezing temperatures in an ice-forming mold to freeze water into ice in the shape of mold cavities during an ice making mode;

b) heating the ice making mold to release the ice therefrom in a harvest mode by separating vaporous and liquid refrigerant within a receiver interconnected between the condenser and the expansion device and feeding vapor from the receiver to the evaporator, wherein the ice-forming mold, evaporator and receiver are disposed in an ice machine unit, and the compressor and condenser are disposed in a condensing unit;

c) determining if said ice making machine is on and if an ice bin switch is closed (41):

(i) if said ice machine is on and said bin switch is closed, then check a high pressure switch (43):

(1) if the high pressure switch is not opened, then return to step (d)(2) below (45); or (2) if the low pressure switch is opened (45), then set a time delay of the ice machine and the condenser for a predetermined time delay (47) and d) determining if said predetermined time delay has elapsed (49):

(1) if said predetermined time delay has not elapsed, then return to step (c)(2) above; or (2) if said predetermined time delay has elapsed, then start said ice making machine and condenser (51).

What is claimed is:

1. A method of making ice in an ice making machine comprising:

a) compressing vaporized refrigerant, cooling the compressed refrigerant to condense it into a liquid, feeding the condensed refrigerant through an expansion device and vaporizing the refrigerant in an evaporator to create freezing temperatures in an ice-forming mold to freeze water into ice in the shape of mold cavities during an ice making mode;

b) heating the ice making mold to release the ice therefrom in a harvest mode by separating vaporous and liquid refrigerant within a receiver interconnected between the condenser and the expansion device and feeding vapor from the receiver to the evaporator, wherein the ice-forming mold, evaporator and receiver are disposed in an ice machine unit, and the compressor and condenser are disposed in a condensing unit;

c) determining if said ice making machine is on and if an ice bin switch is closed:

if said ice machine is on and said bin switch is closed, then check a low pressure switch:

then set a time delay for a predetermined time when the low pressure switch is closed; and d) if the low pressure switch is closed, then setting a time delay for a predetermined time; and determing if said predetermined time delay has elapsed:

(i) if said predetermined time delay has not elapsed, then return to step (d) thereby saving on the life of the compressor and starting components; and (ii) if said predetermined time delay has elapsed, then restarting said compressor in said ice making mode.

2. The method according to claim 1, wherein said restarting said compressor in said ice making mode comprises: closing a cool vapor defrost relay and energizing a contactor coil on said condensing unit.

3. The method according to claim 1, further comprising:

determining if an ice bin is at or above a predetermined level:

(i) if said ice bin is below said predetermined level, then continue to check to determine when said ice bin is full; or (ii) if said ice bin is at or above said predetermined level, then shut said ice making machine off and pump down until a low pressure control switch opens.

4. The method according to claim 3, wherein after opening said low pressure switch, further comprising the step of determining if said ice making machine is on and said bin switch is closed.

5. The method of claim 1, further comprising, during the harvest mode, the step of feeding vaporous refrigerant to said receiver from a compressor by bypassing said condenser through a head pressure control valve.

6. The method of claim 1, wherein during said ice making mode liquid refrigerant passes from said condenser to said receiver through a liquid line and during said harvest mode vaporous refrigerant passes through said liquid line into said receiver.

7. A method of making ice in an ice making machine comprising:

a) compressing vaporized refrigerant, cooling the compressed refrigerant to condense it into a liquid, feeding the condensed refrigerant through an expansion device and vaporizing the refrigerant in an evaporator to create freezing temperatures in an ice-forming mold to freeze water into ice in the shape of mold cavities during an ice making mode;

b) heating the ice making mold to release the ice therefrom in a harvest mode by separating vaporous and liquid refrigerant within a receiver interconnected between the condenser and the expansion device and feeding vapor from the receiver to the evaporator, wherein the ice-forming mold, evaporator and receiver are disposed in an ice machine unit, and the compressor and condenser are disposed in a condensing unit;

c) determining if said ice making machine is on and if an ice bin switch is closed:

(i) if said ice machine is on and said bin switch is closed, then check a high pressure switch:

then set a time delay of the ice machine and the condenser for a predetermined time delay when the high pressure switch is opened; and (d) if the high pressure switch is opened, then setting a time delay for a predetermined time; and determining if said predetermined time delay has elapsed:

(1) if said predetermined time delay has not elapsed, then return to step (c)(i) above thereby saving on the life of compressor and starting components; and (2) if said predetermined time delay has elapsed, then start said ice machine and condesing unit, said compressor restarting in an ice making mode.

* * * * *